US005386473A

United States Patent [19]

Harrison

[11] Patent Number: 5,386,473

[45] Date of Patent: Jan. 31, 1995

[54] PASSIVE SURROUND SOUND CIRCUIT

[76] Inventor: Robert W. Harrison, 18 Westfield Park, Cortland, N.Y. 13045

[21] Appl. No.: 184,648

[22] Filed: Jan. 21, 1994

[51] Int. Cl.[6] ..... H04R 5/00

[52] U.S. Cl. ..... 381/24; 381/1

[58] Field of Search ..... 381/1, 18, 24, 27, 28

[56] References Cited

U.S. PATENT DOCUMENTS

| | | | |
|---|---|---|---|
| 3,197,561 | 7/1965 | Jones | 381/1 |
| 3,697,692 | 10/1972 | Hafler . | |
| 3,725,586 | 4/1973 | Iida | 179/1 G |
| 3,745,254 | 7/1973 | Ohta et al. | 179/1 GQ |
| 3,761,631 | 9/1973 | Ito et al. | 179/1 GQ |
| 4,002,835 | 1/1977 | Bumber | 381/18 |
| 4,132,859 | 1/1979 | Ranga | 179/1 GQ |
| 4,612,663 | 9/1986 | Holbrook et al. | 381/24 |

FOREIGN PATENT DOCUMENTS

| | | | |
|---|---|---|---|
| 0967064 | 8/1964 | United Kingdom | 381/1 |
| 488366 | 10/1975 | U.S.S.R. | 381/1 |

OTHER PUBLICATIONS

"Single Push-Pull Stage for Both Stereo Channels" Norman H. Crowhurst; pp. 48, 49 & 146–148; Jan. 1954.

"The 'Stereo-Plus' System"; Shottenfeld & Staudt; pp. 23 & 114–117; Oct. 1959.

*Primary Examiner*—Stephen Brinich

*Assistant Examiner*—Jerome Grant, II

*Attorney, Agent, or Firm*—Barnard, Brown & Michaels

[57] ABSTRACT

A passive circuit for decoding surround-sound signals using a transformer having center-tapped primary and secondary windings. The line level left and right signals are introduced into the primary winding, and the center tap of the primary supplies a left-plus-right center channel output. The secondary center tap is grounded, and the winding connections supply left-minus-right and right-minus-left surround outputs. The same circuit can be used for recording surround sound onto a two-channel (stereo) medium. A center microphone is connected to the center tap of the primary winding. Left and right surround microphones are connected to the secondary winding, which has its center tap grounded. The left and right recorder inputs are connected to the opposite sides of the primary winding.

15 Claims, 3 Drawing Sheets

PASSIVE SURROUND SOUND CIRCUIT

FIELD OF THE INVENTION

The invention pertains to the field of surround sound. More particularly, the invention pertains to circuits used to encode or decode "presence" or "surround" information in stereo audio sources.

BACKGROUND OF THE INVENTION

In the average movie theater, two types of "surround" systems are used-the 70 mm 6-track magnetic system, and the more common 35 mm optical arrangement. The former uses a magnetic strip attached to the film to supply six discrete channels, and the latter uses two optical audio tracks. This two-channel system is the basis for home surround sound decoders.

Every stereo videodisc, tape and MTS broadcast that was surround encoded still contains the same rear channel information as the two-channel magnetic master from which the theatrical 35mm optical soundtrack was produced. In other words, your stereo videotape or disc of Star Trek I, II, II, Raiders of the Lost Ark, Superman and Star Wars can be decoded to produce surround sound at home. In addition, LPs, CDs and any stereo audio material can benefit from surround sound decoding. Ambiance extraction is a pleasant side effect that many decoders provide. In a nutshell, if the recording was made in a large hall, or a small club, "surround sound" will reproduce the recording environment faithfully.

Assuming the listener is seated centered between the two speakers, sound which is recorded "in phase" and with equal amplitude in each channel in a standard stereo system will appear to the listener to be located equidistant between the two speakers, as the two in-phase audio signals add together. The sound can be shifted left-to-right by varying the ratio of the amplitude of the left and right signals.

"Out of phase" signals, on the other hand, tend to cancel each other out. If a signal is recorded at equal amplitude on each channel of the stereo but 180°out of phase, the listener would ideally hear nothing, as the two signals cancel each other out. As a practical matter, the signals are audible, but sound odd.

By subtracting the left and right signals (L-R), the in-phase signals will be cancelled, and the out-of-phase signals are recovered. This is the basis of the "matrix encoding" which is used to record surround information which is inaudible to listeners with conventional stereo equipment.

"Dolby Surround", a proprietary technique of Dolby Laboratories, inc., is the current standard for multichannel movie sound. The Hollywood mixers start with a conventional stereo soundtrack, which has one left channel and one right. By using some of Mr. Dolby's black boxes, they drop in two more "matrix"-encoded channels--one for the front center channel (used mainly for dialogue), and one for the rear surround channel (used mainly for effects). The rear-channel sound information is mixed "out-of-phase" into both stereo channels ("left-minus-right"), and the center-channel information is derived from the information common to both stereo channels ("left-plus-right").

The center and surround channels must then be decoded from the encoded stereo signal. The center and rear (surround) signals are then reproduced on speakers located between the normal front stereo speakers and behind the listener, respectively.

There are many surround sound decoders on the market today. The simplest of them is the Dynaco model QD-1, which is a version of the decoder described in a 1970 *Audio Magazine* article by David Hafler for use with the then-emerging quadrophonic sound technology (which has since been abandoned). Hafler's U.S. Pat. No. 3,697,692 is essentially the same as the Dynaco QD-1. The Hafler system operates at high levels - that is, the speaker output from the left and right amplifiers is divided among the four speakers, with the (L+R) center speaker connected between the "−" terminal of the L and R speaker and ground, and the (L−R) rear speaker connected across the "+" terminals of the L and R speakers.

Ranga, U.S. Pat. No. 4,132,859, is another high-level system, which is a further development of the Hafler system.

Very good results can be obtained with the Hafler system. However, all high-level systems have a number of basic problems, not the least of which being the expense of using high-power components (L-Pads) to balance the system. Also, the balance controls on the amplifier must be carefully set, using a mono signal, for minimum surround channel output, and then left strictly alone. Any change in the amplifier balance destroys the surround effect.

Most surround decoders currently on the market operate at "line level". That is, they take the left and right signals at preamp level, before they are fed into the final amplifiers. This requires a second set of amplifiers for the two derived channels, but eliminates the need to deal with the power requirements of a high-level decoder. Since the surround channel signals are decoded at constant preamp level, the balance controls on the amplifier (after the decoding) have no effect on the decoding.

All of the low-level decoders known to the inventor use active components (transistors, operational amplifiers, etc.) to decode the surround information from the stereo source. The original decoders were primarily analog circuits, such as may be seen in Holbrook, U.S. Pat. No. 4,612,663, Ito, et.al. (Sansui), U.S. Pat. No. 3,757,047, or Iida (Sony), U.S. Pat. No. 3,725,586. Other low-level active analog systems are Ohta, et. al. (Victor of Japan), U.S. Pat. No. 3,745,254 (using frequency-dependent phasing), Ito, et. al, (Sansui) U.S. Pat. No. 3,761,631 (phase modulates rear channels at an ultra-low frequency rate).

More modern higher-end units today tend to use digital signal processing to achieve the same results. Various kinds of filtering, noise reduction, reverberation, and other effects are often built into these units. All of this adds to the expense and complexity of the decoders. For example, the SONY TAE-1000ESD Surround-sound Processor/pre-amp lists for approximately $1000, and offers a wealth of digital-processing modes, including one of the finest overall surround-sound decoders available; the LEXICON CP-1 Surround-sound Decoder lists for $1250, and has true Dolby Pro-Logic Surround circuitry, 16-bit digital delay, two audio/video inputs, and a full-function wireless remote control. The CP-1 also features an "auto azimuth correction" mode designed specifically to prevent dialogue from leaking into the rear channel, and a number of digital signal processing effects modes.

All of these active decoding systems, especially the digital ones, involve complicated and expensive electronics, and relatively high prices.

The Dolby Surround System introduces a digital delay into the surround (rear) channel. There are several reasons advanced for this. One is to delay the rear signal so that the front and rear signals arrive at the listener's ears at the same time. This would appear to be a poor technique, since it would depend entirely on where the listener sits relative to the two sets of speaker. Others suggest that the "Haas effect" causes a listener to localize sound to the direction it is heard first. By delaying the rear sound by a fixed amount, usually 20 milliseconds, the listener is tricked into hearing the sounds as being primarily front/center, and the effect of stray sounds being erroneously shifted to the rear is minimized. Some units add a variable delay control, which allows the user to change the length of the fixed delay, but whatever the user chooses, the delay remains fixed at whatever the chosen length is.

Twenty milliseconds is the period of one cycle at a frequency of 50 Hz. This means that the only sounds which are correctly phased with a 20 ms delay system are those which are even multiples (harmonics) of 50 Hz. All others are to a greater or lesser degree out of phase. Frequencies between the peaks can be greatly attenuated or cancelled completely due to out-of-phase mixing. This creates a situation which is every audio engineer's nightmare—an overall system response with a peak in every octave, caused by speakers which are in phase only near certain frequencies. It is advantageous, then, to eliminate the use of delays in the surround sound decoding.

SUMMARY OF THE INVENTION

The invention presents a passive circuit for surround-sound decoding using a transformer having center-tapped primary and secondary windings. The line level left and right signals are introduced into the primary winding, and the center tap of the primary supplies a left-plus-right center channel output. The secondary center tap is grounded, and the winding connections supply left-minus-right and right-minus-left surround outputs.

The same circuit can be used for recording surround sound onto a two-channel (stereo) medium. A center microphone is connected to the center tap of the primary winding. Left and right surround microphones are connected to the secondary winding, which has its center tap grounded. The left and right recorder inputs are connected to the opposite sides of the primary winding.

DESCRIPTION OF THE PREFERRED EMBODIMENT

Figure 2:
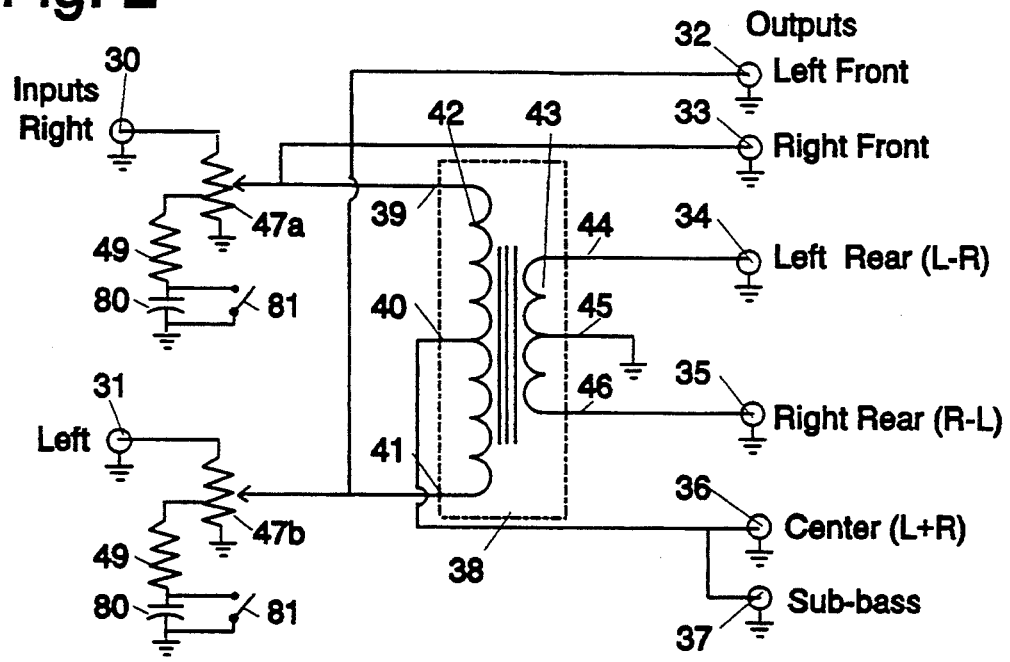
FIG. 2 shows a schematic of the circuit of the invention.

FIG. 2 shows the circuit of the invention. As can be seen from that figure, the basic element of the circuit is an audio transformer (38) which has primary (42) and secondary (43) windings. Each of the windings is equipped with connections at each end: (39) and (41) on the primary, and (44) and (46) on the secondary windings. Each winding also has a center tap connection midway between the end connections: (40) on the primary and (45) on the secondary.

The transformer can be any audio type having suitable impedance characteristics for the application. For the typical preamp input/output situation with current technology audio equipment, it would be recognized by one skilled in the art that input impedances in excess of 1KΩ, and outputs at or below 1KΩ would be appropriate. Other applications, or changes in standards in the future, might require other impedance ranges, which would be within the ability of one skilled in the art to select.

Because the circuit operates at low power levels (that is, at the preamp input levels rather than amplifier output levels) it is preferred to use a small, low power transformer for economic and space reasons.

The preferred embodiment of the invention uses a transformer having a primary (input) winding of 10KΩ impedance (5KΩ each side of center tap) and a secondary winding of 2KΩ impedance (1KΩ each side of center tap). Such a transformer may be purchased from Triad, selected from series number SP-21, which is a series of small transformers, specifically model TF5S21ZZ.

Since low bass sounds are essentially non-directional, there is no need to pass these frequencies through to the surround channels. Therefore, the preferred transformer has frequency characteristics which are flat above 300 Hz, and which roll off −3 dB at 200 Hz, and essentially cut off frequencies below 100 Hz.

The right (30) and left (31) channels of the stereo signal having the out-of-phase surround information is supplied to the primary of the transformer at the end connections (39) and (41), respectively. To make the connections to the audio equipment easier, left (32) and right (33) front outputs are connected directly to these inputs, so that the front channel sound information can be taken from the source, "looped" through the box containing the circuit of the invention, and routed to the inputs of the front channel amplifier. It will be understood that these outputs can be dispensed with, if the outputs of the signal source are connected to the circuit and the front amplifier using "Y" patch cords to parallel the inputs.

If desired, a number of input connectors can be provided, for multiple signal sources such as VCR's, CD players, stereo or TV tuners, etc. In such cases a double-pole multi-throw switch would be included to switch left/right input pairs to the left (30) and right (31) inputs to the circuit.

Ganged potentiometers (47*a*) (47*b*) may be included as system master volume control to control overall level of the the front and center/rear (surround) speakers. The potentiometers are tapped (48) at 40% from the grounded end, and a 2.2KΩ resistor (49) and 0.047 μf capacitor (80) is in series to ground to provide a loudness compensation. The capacitor (80) is shorted by switch (81) to defeat the loudness compensation.

The center tap (40) of the primary winding (42) supplies the in-phase sum of the two input signals (Left+Right) to a center channel output (36). Since this center tap is connected through the primary winding to the left and right inputs at the ends of the primary winding, the center channel output (36) has DC continuity with the two input channels. In other words, the 100 Hz cut-off does not apply to the center channel signal. Thus, the center output (36) may be paralleled with a sub-bass output (37), which can be used to drive a sub-woofer amplifier. Since sub-bass audio is non-directional, only one sub-woofer speaker on the L+R signal is required, rather than separate Left and Right Sub-woofers.

The secondary winding (43) supplies difference signals (L−R) and (R−L) for driving Left Rear (34) and Right Rear (46) outputs from the end connections (35) and (46), respectively. These two outputs are identical, but 180°out of phase with each other. The center tap (45) of the secondary winding (43) is grounded.

This difference signal extracts the out of phase surround information from the Right and Left input signals, and the sum signal cancels the surround information and passes the in-phase front channel information.

That is, if a sound source is to appear in center front, it is mixed by the film audio editors equally, in phase, to the left and right channels. If the signal is denoted as "X" then X+X (the L+R center channel)=2X. On the other hand, X−X (the L−R rear surround channel)=0, or no signal.

If a sound source is to appear only in the rear (surround) speaker(s), it is mixed, out of phase, equally onto the left (L) and right (R) signals - i.e. X to the left channel and −X to the right (or vice versa). Then, the center channel (L+R) will have no signal: X+(−X)=0. The rear (surround) channels (R−L) and (L−R), however will have the signal reproduced: X−(−X)=2X, and (−X)−X=(−2X).

Figure 1:
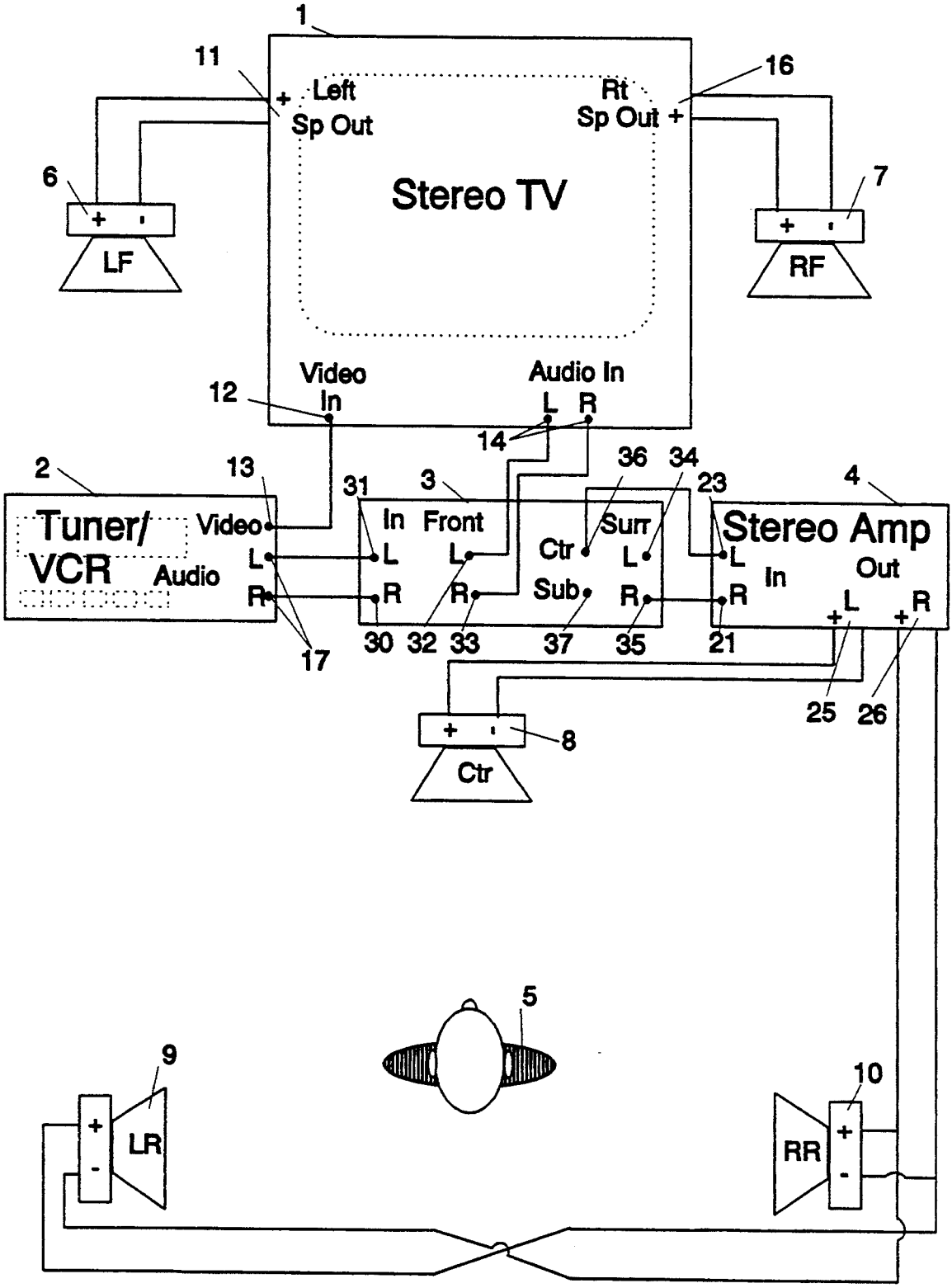
FIG. 1 shows a block diagram of the circuit in use.

FIG. 1 shows how the circuit of the invention is used in a surround-sound home theater system. The system comprises a stereo TV set (1) used for display of the TV picture and for amplification of the front channel audio, a tuner/vcr (2) which supplies the video and audio signals for the system, the surround decoder of the invention (3) and a stereo amplifier (4), used to amplify the surround and center channel audio.

In the preferred embodiment shown, five speakers are used: left (6) and right (7) front, center (8) and left (9) and right (10) rear/surround. They are shown as they would be placed around the listener (5). The center (8) speaker would normally be put facing the listener (5) either immediately above or below the TV screen. The front left (6) and right (7) speakers would flank the TV screen, perhaps 6 feet or so apart, facing the listener (5). The surround speakers (9) and (10) are behind the listener (5), preferably facing inwards.

The video output (13) of the tuner/vcr (2) is connected to the video input (12) of the stereo TV (1). The left and right (17) audio outputs of the tuner/VCR are fed into the decoder (3), and "loop" through to the audio inputs (14) of the stereo TV (1) which then drives the left (6) and right (7) front speakers from its left (11) and right (16) speaker outputs. If desired, a discrete stereo amplifier could be used to drive the front speakers in place of the audio system in the TV set.

Since the left (34) and right (35) surround outputs from the decoder (3) are the same, except 180°out of phase, it is not necessary to separately amplify the two. Optionally, only one (35) may be used as an input to one channel (21) of the stereo amplifier (4). The corresponding output (26) of the amplifier feeds the right (10) surround speaker directly, and the left (9) surround speaker is connected in parallel, but with the wires reversed. The reversed wires result in an audio signal which is 180°out of phase, or the same as that produced by the other surround output from the decoder. This connection allows the other channel of the stereo amplifier (23) to be used to amplify the center channel output (36) of the decoder (3) and drive center speaker (8).

If the user desires, the two surround speakers could be replaced by a single bipolar (bi-directional) speaker centered behind the listener.

A sub-woofer amplifier and speaker (not shown) could be connected to the sub-bass output (37) of the decoder. Since sub-bass sound is not directional, the subwoofer could be placed anywhere convenient in the room.

Figure 3:
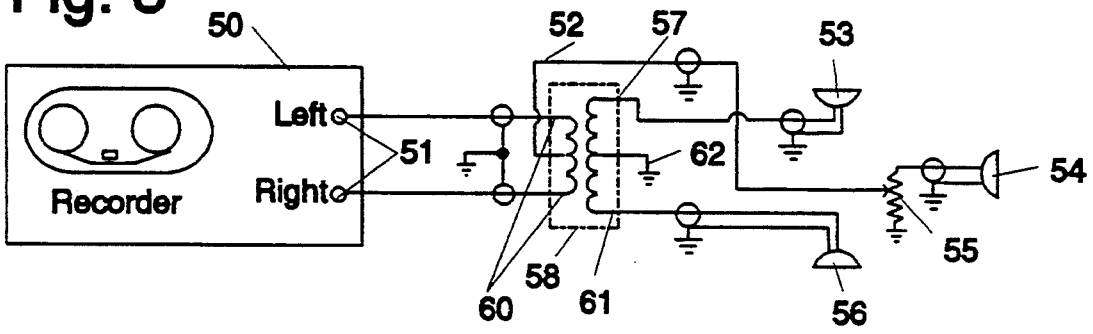
FIG. 3 shows the circuit in use to record surround sound.
Figure 4:
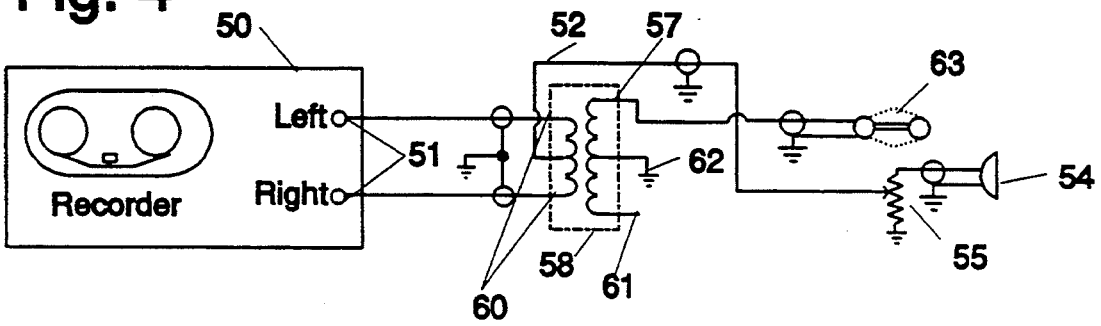
FIG. 4 shows an alternative connection of the circuit as used to record surround sound.

The decoder circuit of the invention can be used, in reverse, to record stereo audio with surround information. FIGS. 3 and 4 show the circuit in use in such an application. The recorder (5) could be an audio recorder, or a video camera/recorder with stereo audio.

In the configuration shown in FIG. 3, three microphones—center (54), left surround (53) and right surround (56)—are used to record the sound. The configuration of FIG. 4 is otherwise identical, but uses one bipolar microphone (63) (such as a ribbon microphone) to record the surround information.

The center microphone can be the conventional microphone on the camcorder, or could be a remote microphone centered on the subject (i.e. actor or stage) and transmitting back to the camcorder by an IR or RF link. In any event, the center microphone is used to record the subject, dialog, etc.

The surround microphone(s) record the ambiance/-surround information. They would preferably be placed on the camcorder or behind it, pointed outwards.

The left and right record inputs (51) on the recorder (50) are connected to the end connections of the primary winding (60) of the transformer (58). The center microphone (54) signal is connected to the center tap (52) of the primary winding, possibly through a balance control (55). As before, the center tap of the secondary winding (62) is grounded.

If there are two surround microphones (FIG. 3) (53) and (56), they are connected to the end connections (57) and (61) of the secondary winding of the transformer (58). If one bipolar microphone (FIG. 4) (63) is used, it is connected to one of the end connections (57) of the secondary winding of the transformer, and the other is left unused.

Figure 5:
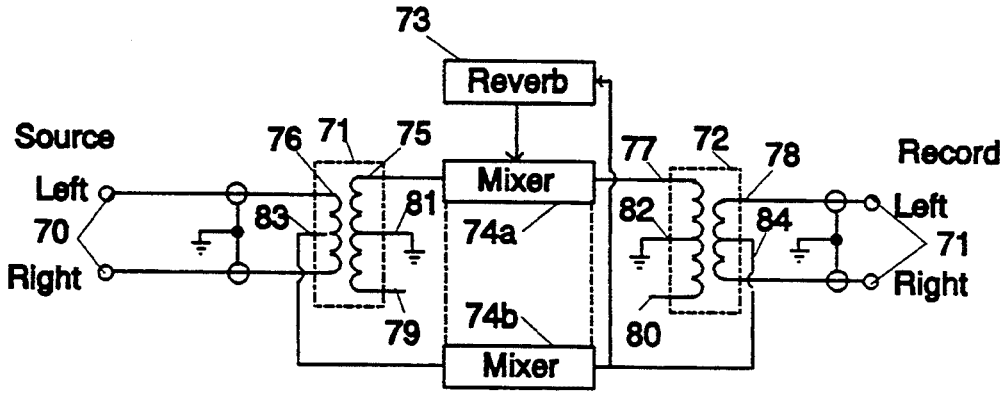
FIG. 5 shows the circuit as used to modify or create surround sound on recordings which were not originally recorded with the surround information.

FIG. 5 shows how the circuit may be used in pairs, back to back, to modify existing stereo recordings to incorporate a simulation of surround sound (sometimes called "magic surround").

The source input (70) is fed into the end connections of the primary winding (76) of first transformer (71). The outputs from this transformer are the L+R sum signal from the center tap (83) of the primary winding of the first transformer (71) and the L−R difference signal from one end connection (75) of the secondary winding. The center tap of the secondary (81) is once again grounded, and the other end connection (79) of the secondary is unused.

The sum and difference signals are fed into the two channels of a stereo mixer (74*a*) (74*b*). The sum signal is simply amplified by one channel of the mixer and passed on to the center tap (84) of the primary winding of the second transformer (72). The end connections of the primary winding (78) of the second transformer (72) become the input (71) to a recorder.

The difference signal (L−R) passes through the other channel of the stereo mixer (74) and to one of the end connections (77) of the secondary winding of the second transformer (72). The other end connection (80) is unused, and the center tap (82) of the secondary is grounded.

This arrangement can create surround effects through the use of a reverberator (73) in the difference signal channel of the stereo mixer (74*a*). By separating sum and difference signals in the first transformer (71), adding reverb or other effects to the difference channel in the mixer (74), then recombining the signals in the second transformer (72), left and right output signals (71) with a simulation of surround sound can be created. The input to the reverb may be taken from the center channel mixer (74*b*) which will provide a realistic surround effect.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

I claim:

1. A surround sound circuit for decoding surround sound information from a stereo signal comprising left and right channels having out-of-phase rear channel information encoded therein, comprising:

left and right audio input means for accepting signals from the left and right channels of the stereo signal, a center channel audio output means for supplying a signal representing the sum of the left and right input signals, a first rear channel audio output means for supplying a signal representing the difference between the left and right input signals, a transformer having primary and secondary windings, the primary winding of the transformer having first and second connections at each end of the winding and a center tap connection midway therebetween, the left and right audio input means being connected to the first and second connections of the primary winding of the transformer, the secondary winding of the transformer having end connections at each end of the winding and a center tap connection midway therebetween, the center tap connection of the secondary winding of the transformer being grounded, the center channel output means being connected to the center tap connection of the primary winding of the transformer, the first rear channel output means being connected to an end connection of the secondary winding of the transformer.

2. The surround sound circuit of claim 1, further comprising a second rear channel output means connected to the opposite end connection of the secondary winding from the end connected to the first rear channel output.

3. The surround sound circuit of claim 1, further comprising right and left channel output means connected to the left and right audio input means.

4. A surround sound system comprising, a) a transformer having primary and secondary windings, the primary winding of the transformer having first and second connections at each end of the winding and a center tap connection midway therebetween, the secondary winding of the transformer having end connections at each end of the winding and a center tap connection midway therebetween, the center tap connection of the secondary winding of the transformer being grounded, b) a stereo signal source for providing left and right channel signals having out-of-phase rear channel information encoded therein, connected to the first and second connections of the primary winding of the transformer, c) right and left front-channel amplifiers having inputs connected to the right and left channel signals from the stereo signal source, and outputs for driving left and right front speakers, d) a center channel amplifier having an input connected to the center tap connection of the primary winding of the transformer, and an output for driving a center speaker between the left and right front speakers, e) a rear channel amplifier having an input connected to an end connection of the secondary winding of the transformer, and an output for driving a surround speaker.

5. The surround sound system of claim 4 in which the rear channel amplifier output drives one bipolar rear speaker.

6. The surround sound system of claim 4 in which the rear channel amplifier output drives two rear speakers connected out of phase with each other.

7. The surround sound system of claim 4 further comprising a second rear channel amplifier having an input connected to the other end connection of the secondary winding of the transformer from the end connection to which the rear channel amplifier claimed in claim 4 is connected, and an output for driving a second surround speaker.

8. The surround sound system of claim 4 in which the stereo signal source is a television tuner.

9. The surround sound system of claim 4 in which the stereo signal source is a video tape player.

10. The method of decoding surround sound information from a stereo signal comprising left and right channels having out-of-phase rear channel information encoded therein, comprising the steps of:

a) supplying the left and right channel signals of the stereo signal to the end taps of the primary winding of a transformer having primary and secondary windings, the primary winding of the transformer having first and second connections at each end of the winding and a center tap connection midway therebetween, the secondary winding of the transformer having end connections at each end of the winding and a grounded center tap connection midway therebetween, b) amplifying the signal on the center tap connection of the primary winding of the transformer, and driving a center front speaker from the amplified signal, c) amplifying the signal on an end connection of the secondary winding of the transformer, and driving at least one rear surround speaker from the amplified signal.

11. The method of claim 10, further comprising the step of amplifying the signal on the other end connection of the secondary winding, and driving a rear surround speaker from the amplified signal.

12. The method of claim 10, in which the amplified signal drives two rear surround speakers connected out of phase from each other.

13. The method of claim 10, in which the amplified signal drives one bipolar rear surround speaker.

14. The method of recording a two-channel stereo signal having surround information encoded therein using a stereo audio recorder having left and right record inputs, comprising the steps of:

a) supplying the left and right record inputs of the stereo recorder from the end taps of the primary winding of a transformer having primary and secondary windings, the primary winding of the transformer having first and second connections at each end of the winding and a center tap connection midway therebetween, the secondary winding of the transformer having end connections at each end of the winding and a grounded center tap connection midway therebetween, b) supplying a signal from a center microphone to the center tap connection of the primary winding of the transformer, c) supplying a signal from a left surround microphone to one end connection of the secondary winding of the transformer, d) supplying a signal from a right surround microphone to the other end connection of the secondary winding of the transformer.

15. The method of recording a two-channel stereo signal having surround information encoded therein using a stereo audio recorder having left and right record inputs, comprising the steps of a) supplying the left and right record inputs of the stereo recorder from the end taps of the primary winding of a transformer having primary and secondary windings, the primary winding of the transformer having first and second connections at each end of the winding and a center tap connection midway therebetween, the secondary winding of the transformer having end connections at each end of the winding and a grounded center tap connection midway therebetween, b) supplying a signal from a center microphone to the center tap connection of the primary winding of the transformer, c) supplying a signal from a bipolar surround microphone to one end connection of the secondary winding of the transformer.

* * * * *